US009092011B2

(12) United States Patent
Takahashi

(10) Patent No.: US 9,092,011 B2
(45) Date of Patent: Jul. 28, 2015

(54) IMAGE FORMING APPARATUS

(71) Applicant: KYOCERA Document Solutions Inc., Osaka-shi, Osaka (JP)

(72) Inventor: Hiroki Takahashi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/494,750

(22) Filed: Sep. 24, 2014

(65) Prior Publication Data

US 2015/0086233 A1 Mar. 26, 2015

(30) Foreign Application Priority Data

Sep. 26, 2013 (JP) ..... 2013-200028

(51) Int. Cl.
*G03G 21/20* (2006.01)

(52) U.S. Cl.
CPC ..... *G03G 21/206* (2013.01); *G03G 2215/0132* (2013.01)

(58) Field of Classification Search
CPC ..... G03G 2221/1645
See application file for complete search history.

(56) References Cited

U.S. PATENT DOCUMENTS 7,877,038 B2 * 1/2011 Kim et al. ..... 399/92
2008/0267666 A1 * 10/2008 Shirokoshi et al. ..... 399/222

FOREIGN PATENT DOCUMENTS

JP 2008-203703 9/2008

* cited by examiner

*Primary Examiner* — Gregory H Curran
(74) *Attorney, Agent, or Firm* — Gerald E. Hespos; Michael J. Porco; Matthew T. Hespos

(57) ABSTRACT

An image forming apparatus includes an apparatus body, an image forming portion, a hold portion, a cooling air passage, and a communication opening. The apparatus body includes a front wall, and a side wall standing perpendicularly to the front wall, the front wall and the side wall defining an internal space. The image forming portion is disposed in the internal space, and forms an image on a sheet. The hold portion is in the form of a hollow at a part of the side wall, and adapted to be held when moving the apparatus body. The cooling air passage extends in the internal space vertically along the side wall. The communication opening allows communication between a space defined by the hold portion and a lower part of the cooling air passage.

10 Claims, 7 Drawing Sheets

IMAGE FORMING APPARATUS

This application is based on Japanese Patent Application No. 2013-200028 filed with the Japan Patent Office on Sep. 26, 2013, the contents of which are hereby incorporated by reference.

BACKGROUND

The present disclosure relates to an image forming apparatus for forming an image on a sheet.

In conventional image forming apparatuses, a toner image is formed on a photoreceptor drum by a developing device and then transferred onto a sheet at a transfer section. The image forming apparatus further includes a fixing section, and the sheet having the toner image transferred thereon is subjected to a fixing treatment at the fixing section and then discharged.

Conventionally, there is known a technique for producing a cooling airflow in a body of an image forming apparatus. The air flows into the apparatus body through an intake port that communicates with a hold portion on a front cover.

SUMMARY

An image forming apparatus according to an aspect of the present disclosure includes an apparatus body, an image forming portion, a hold portion, a cooling air passage, and a communication opening. The apparatus body includes a front wall, and a side wall standing perpendicularly to the front wall, the front wall and the side wall defining an internal space. The image forming portion is disposed in the internal space and forms an image on a sheet. The hold portion is in the form of a hollow at a part of the side wall and adapted to be held when moving the apparatus body. The cooling air passage extends in the internal space vertically along the side wall. The communication opening allows communication between a space defined by the hold portion and a lower part of the cooling air passage.

These and other objects, features and advantages of the present disclosure will become more apparent upon reading the following detailed description along with the accompanying drawings.

DETAILED DESCRIPTION

<First Embodiment>

Figure 1:
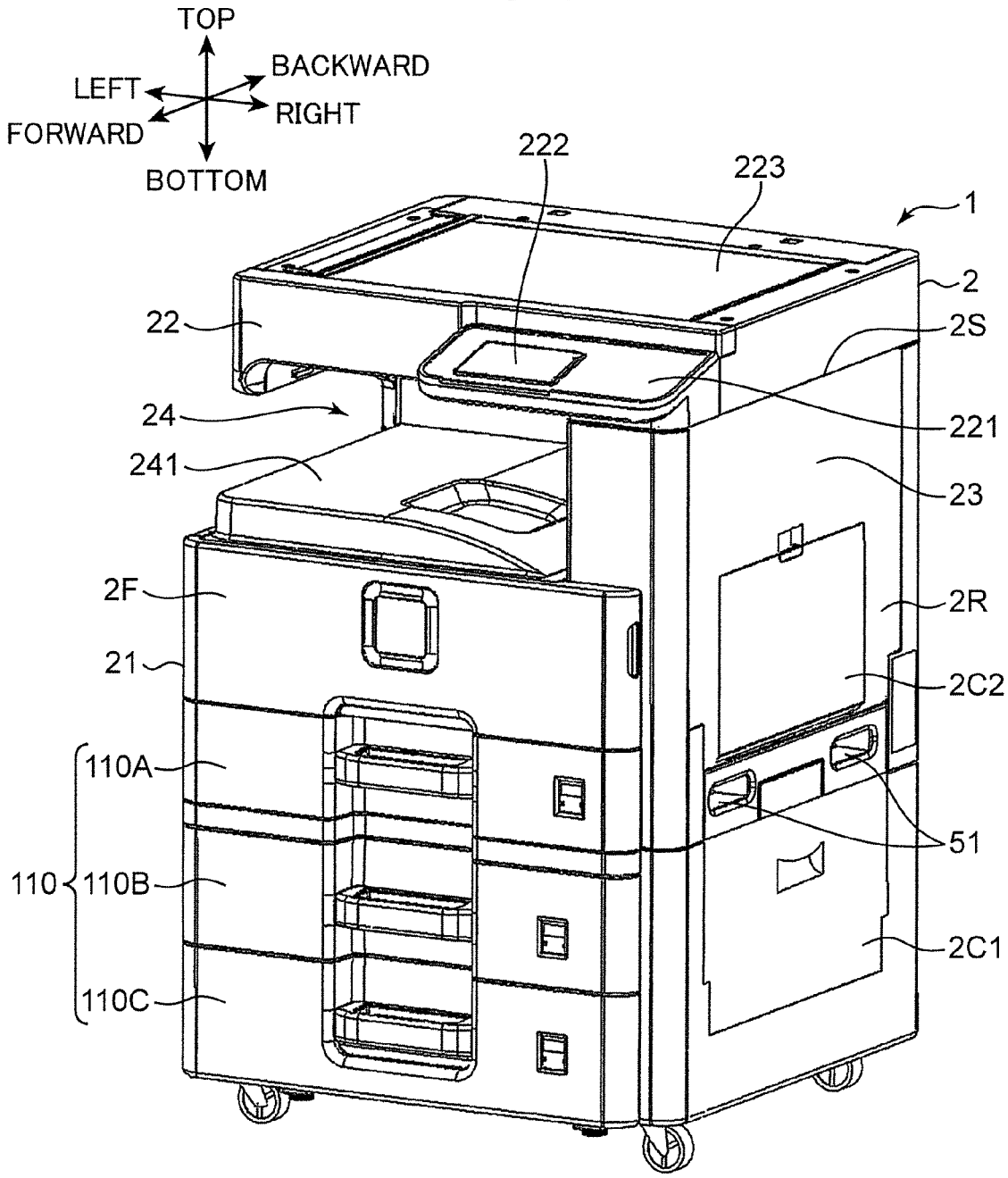
FIG. 1 is a perspective view of an image forming apparatus according to a first embodiment of the present disclosure.
Figure 2:
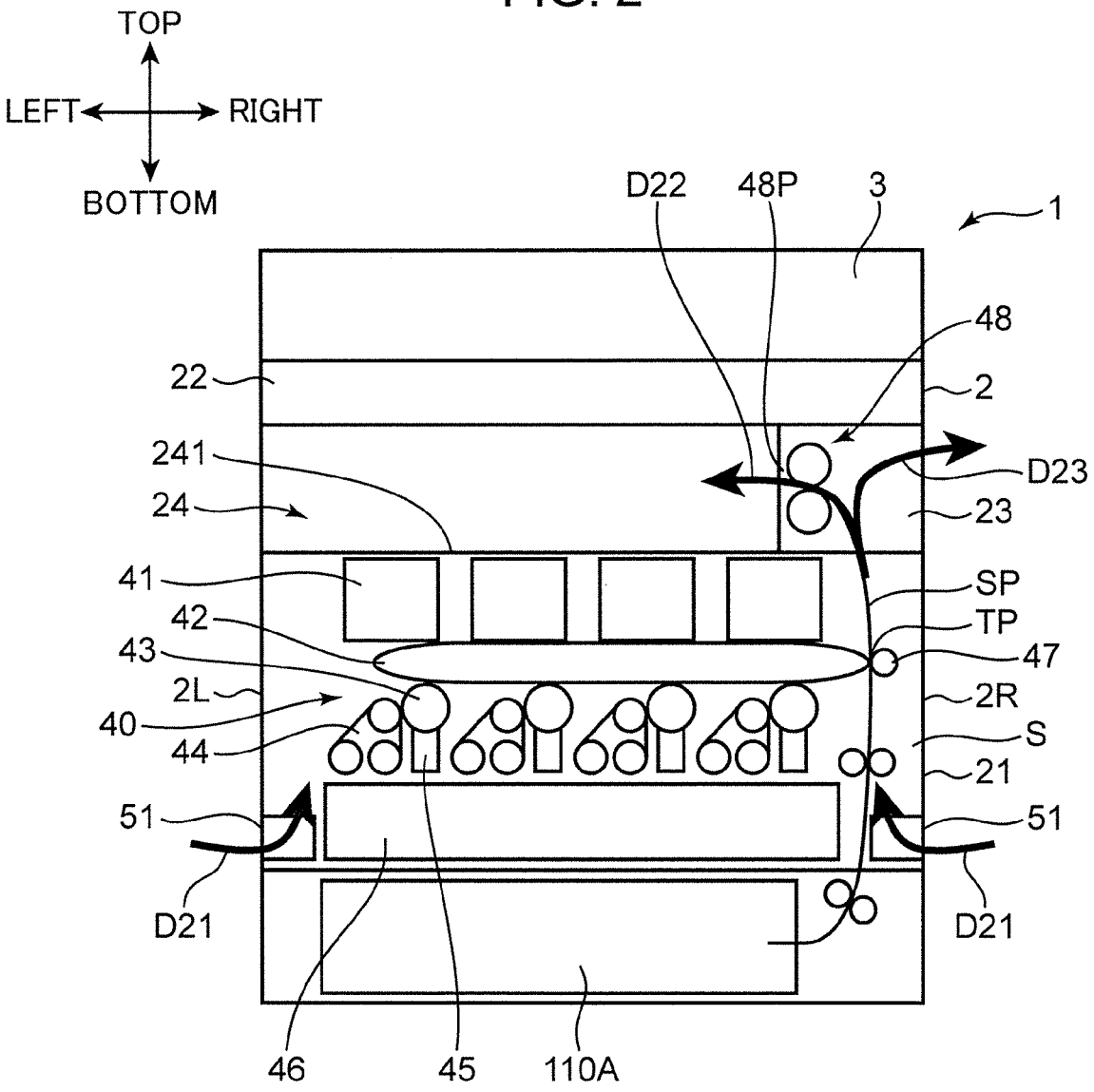
FIG. 2 is a schematic sectional view showing an internal structure of the image forming apparatus according to the first embodiment of the present disclosure.

Hereinafter, a first embodiment of the present disclosure will be described with reference to the accompanying drawings. FIG. 1 is an external perspective view of an image forming apparatus 1 according to the first embodiment of the present disclosure. FIG. 2 is an internal sectional view of the image forming apparatus 1. Compared to FIG. 2, FIG. 1 does not show an automatic document feeding unit to be described later. The image forming apparatus 1 shown in FIGS. 1 and 2 is a so-called full-color multifunction printer, but other apparatuses for forming a toner image on a sheet, such as a monochrome multifunction printer, a full-color printer, and a facsimile apparatus, may alternatively be used as an image forming apparatus in other embodiments. Terms indicating directions, such as "up" "down" "forward" "backward" "left" and "right", will be used hereinafter merely for the purpose of clarifying the description and, therefore, not intended to limit the principle of the image forming apparatus. In addition, the term "sheet" used hereinafter will refer to a copy paper, a coated paper, an OHP sheet, a thick paper, a postcard, a tracing paper, and other sheet materials subjected to image formation or any processing other than image formation.

The image forming apparatus 1 includes an apparatus body 2 having a substantially rectangular shape. The apparatus body 2 includes a lower housing 21 having a substantially rectangular shape, an upper housing 22 disposed above the lower housing 21 and having a substantially rectangular shape, and a connecting housing 23 connecting the lower housing 21 and the upper housing 22. The connecting housing 23 extends along right and rear edges of the apparatus body 2. The lower housing 21, the upper housing 22, and the connecting housing 23 defines a discharge space 24, to which a sheet formed with an image is discharged. In the present embodiment, a sheet formed with an image is discharged onto a discharge portion 241 disposed on the upper surface of the lower housing 21. The discharge portion 241 is located above an image forming portion 40 to be described later.

There is an operation section 221 which is disposed on the front side of the upper housing 22 and includes, for example, an LCD touch panel 222. The operation section 221 can receive input of information relating to image formation. The LCD touch panel 222 allows a user to set the number, the print density or the like of sheets to be printed, for example.

An unillustrated reading section is disposed in the upper housing 22. The reading section reads an image of an original document sheet via a contact glass 223 (FIG. 1) disposed on the upper surface of the upper housing 22. The automatic document feeding unit 3 is disposed over the upper housing 22 (FIG. 2). The automatic document feeding unit 3 successively feeds original document sheets so that each of them passes a predetermined document reading position on the contact glass 223.

The lower housing 21 defines an internal space S in which various components to be described later are disposed (FIG. 2). The lower housing 21 includes a front wall 2F, a right wall 2R (side wall), and a left wall 2L (FIG. 2). The front wall 2F is a front wall of the lower housing 21. The right wall 2R and the left wall 2L are right and left side walls of the lower housing 21, respectively, the right and left walls standing vertically and perpendicularly to the front wall 2F. The image forming apparatus 1 includes, in the internal space S, sheet feeding trays 110 (sheet storages), an unillustrated sheet feeding section, and the image forming portion 40.

The sheet feeding tray 110 stores sheets therein. The sheet feeding tray 110 can be pulled out from the lower housing 21 in the front direction (forward direction). A sheet stored in the sheet feeding tray 110 is fed upward in the lower housing 21. The sheet feeding tray 110 includes an unillustrated lift plate for supporting the sheet. The lift plate is tilted to lift a leading edge (right edge) of the sheet. With reference to FIG. 1, the sheet feeding trays 110 include a first tray 110A, a second tray 110B, and a third tray 110C, of which only the first tray 110A is shown in FIG. 2. The sheet feeding trays 110 are disposed below the image forming portion 40.

The sheet feeding section feeds a sheet to a vertical conveyance path SP (first sheet conveyance path, cooling air passage). The vertical conveyance path SP extends to the discharge section 241 through a zone facing the image forming portion 40. A sheet is conveyed through the vertical conveyance path SP.

The image forming portion 40 is disposed in the internal space S, and forms an image on a sheet. The image forming portion 40 includes toner containers 41, an intermediate transfer belt 42, photoreceptor drums 43, developing devices 44, chargers 45, an exposure device 46, an unillustrated cleaning device, and a secondary transfer roller 47. As described above, in the present embodiment, the image forming apparatus 1 forms a toner image in full color on a sheet. Therefore, as shown in FIG. 2, the image forming portion 40 includes the toner containers 41 for color toners of yellow, magenta, cyan and black in the order from left to right, the developing devices 44, the photoreceptor drums 43, the chargers 45, and the cleaning device.

The photoreceptor drum 43 has a cylindrical shape. The photoreceptor drum 43 rotates around its central axis. The photoreceptor drum 43 has a circumferential surface to be formed with an electrostatic latent image and carry a toner image corresponding to the electrostatic latent image. An example of the photoreceptor drum 43 is a photoreceptor drum using an amorphous silicon (a-Si) material. In FIG. 2, the photoreceptor drum 43 is rotationally driven clockwise.

The charger 45 is applied with a specific voltage, and charges the circumferential surface of the photoreceptor drum 43 substantially uniformly. The exposure device 46 irradiates the circumferential surface of the photoreceptor drum 43 charged by the charger 45 with laser light. The laser light is emitted in accordance with image data output from an external device such as personal computer (unillustrated) that is communicably connected to the image forming apparatus 1. Consequently, the circumferential surface of the photoreceptor drum 43 is formed with an electrostatic latent image corresponding to the image data.

The developing device 44 supplies toner to the circumferential surface of the photoreceptor drum 43, the circumferential surface being formed with the electrostatic latent image. The developing device is supplied with toner by the toner container 41. When the developing device 44 has supplied toner to the photoreceptor drum 43, the electrostatic latent image formed on the circumferential surface of the photoreceptor drum 43 is developed (visualized). Consequently, the circumferential surface of the photoreceptor drum 43 is formed with a toner image.

The intermediate transfer belt 42 is disposed horizontally above the photoreceptor drums 43 for the respective colors. The intermediate transfer belt 42 is an endless belt which is wound around an unillustrated pair of rollers disposed on laterally opposite ends. In FIG. 2, the intermediate transfer belt 42 runs circularly counter-clockwise. In addition, unillustrated primary transfer rollers are disposed on the inner peripheral surface of the intermediate transfer belt 42 so as to face the photoreceptor drums 43 for the respective colors in one-to-one correspondence. The primary transfer roller transfers a toner image on the photoreceptor drum 43 onto the intermediate transfer belt 42.

The cleaning device removes toner remaining on the circumferential surface of the photoreceptor drum 43 after a toner image is transferred therefrom onto a sheet. The circumferential surface of the photoreceptor drum 43 having been cleaned by the cleaning device passes above the charger 45 again to be uniformly charged. Thereafter, a new formation of toner image is performed as described above.

The second transfer roller 47 is disposed so as to face the surface of the intermediate transfer belt 42 at a transfer position TP. The second transfer roller 47 rotationally driven in the same direction as the intermediate transfer belt 42 at the transfer position TP. Toner images in the respective colors that are formed on the surface of the intermediate transfer belt 42 are transferred onto a sheet together at the transfer position TP.

The image forming apparatus 1 further includes a fixing device (unillustrated) for fixing a toner image on a sheet, the fixing device being disposed downstream in a conveyance direction from the image forming portion 40. The fixing device includes a heating roller for melting the toner on the sheet, and a pressure roller for fixing the sheet to the heating roller. The sheet passes through a nip between the heating roller and the pressure roller where the toner image is fixed on the sheet.

The image forming apparatus 1 includes a discharge roller 48 disposed downstream from the fixing device 130 in the vertical conveyance path SP. The discharge roller 48 conveys a sheet having been subjected to fixing by the fixing device to the downstream side in the sheet conveyance direction. Consequently, the sheet is discharged onto the discharge section 241 through a discharge opening 48P that is opened in the connecting housing 23 adjacently to the discharge roller 48.

With reference to FIG. 1, the image forming apparatus 1 further includes a lower cover 2C1, an upper cover 2C2, and first hold portions 51. The lower cover 2C1 is openable with respect to the right wall 2R. The upper cover 2C2 is similarly openable with respect to the right wall 2R, the upper cover being located above the lower cover 2C1. The lower cover 2C1 and the upper cover 2C2 are rotatable, with respective lower ends serving as a fulcrum. When the lower cover 2C1 and the upper cover 2C2 are opened, a part of the vertical conveyance path SP is exposed to the outside of the apparatus body 2. This allows a user of the image forming apparatus 1 to remove a sheet jammed in the vertical conveyance path SP.

The first hold portion 51 is provided in the right wall 2R and the left wall 2L. Although FIG. 1 does not show the first hold portion 51 in the left wall 2L, it is also provided in the left wall 2L as shown in FIG. 2. The first hold portions 51 are formed by making a hollow at a part of the right wall 2R and a part of the left wall 2L. The first hold portions 51 are held by a worker when moving the apparatus body 2 of the image forming apparatus 1.

Figure 3:
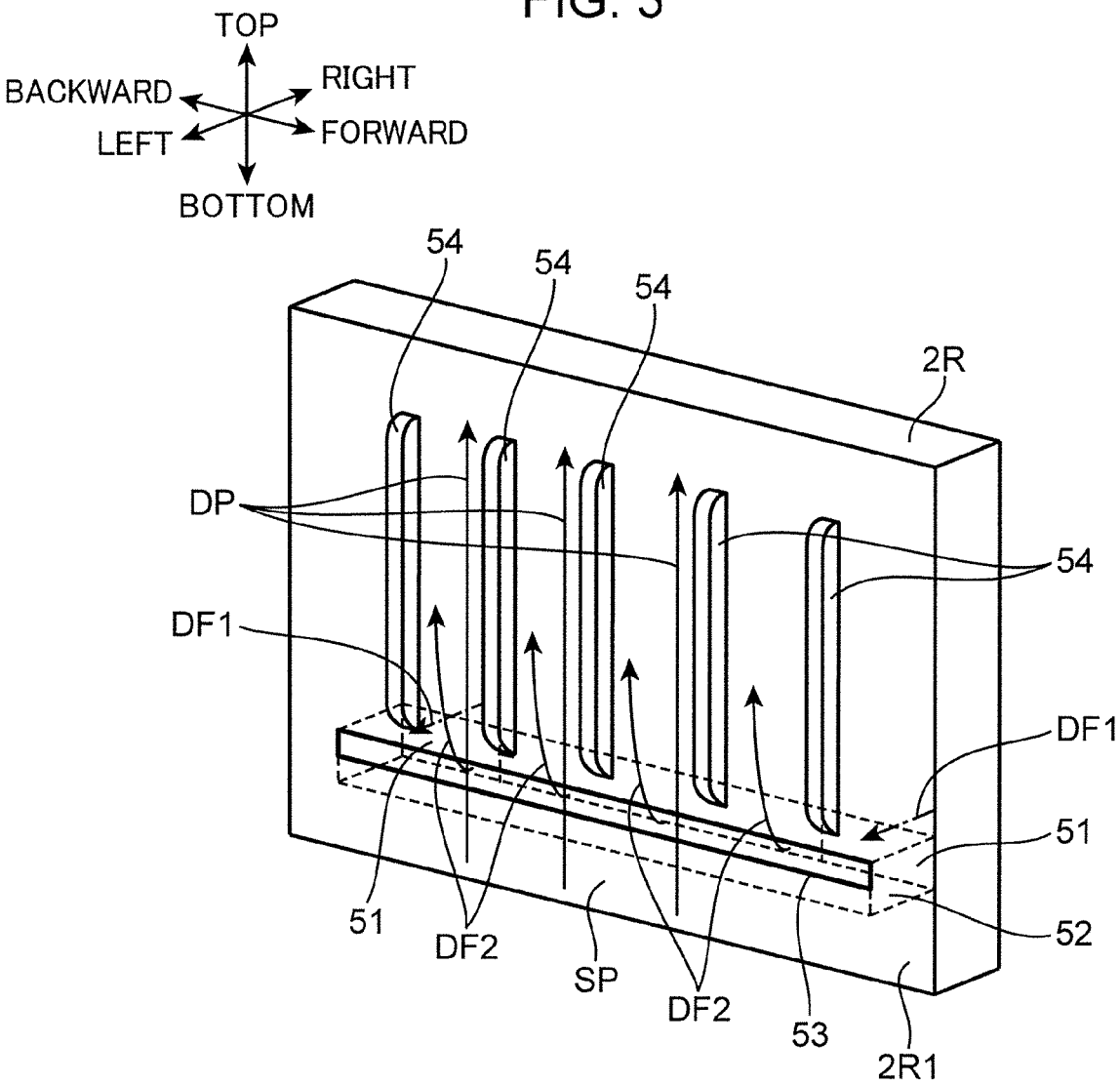
FIG. 3 is a perspective view of a cooling air passage in the image forming apparatus according to the first embodiment of the present disclosure.

FIG. 3 is a perspective view showing a part of the vertical conveyance path SP in the apparatus body 2. The right wall 2R includes a first inner wall surface 2R1. The first inner wall surface 2R1 is located on the inner side of the right wall 2R, and defines a part of the vertical conveyance path SP. As shown in FIG. 3, the first hold portion 51 of the right wall 2R defines a first communication space 52 provided in the right wall 2R. Specifically, the first communication space 52 allows a pair of front and back hold portions constituting the first hold portion 51 to communicate with each other in the right wall 2R. Further, the image forming apparatus 1 includes a first blowout opening 53 (communication opening). The first blowout opening 53 is formed in the inner right wall surface 2R1 so as to face the vertical conveying path SP. The first blowout opening 53 has a small height and extends in the forward and backward direction. The first blowout opening 53 allows the first communication space 52 defined by the first hold portion 51 to communicate with a lower part of the vertical conveyance path SP.

In the present embodiment, a part of the vertical conveyance path SP functions as a cooling air passage for cooling the inside of the apparatus body 2. The cooling air passage vertically extends along the right wall 2R in the internal space S.

With reference to FIG. 2, air flows into the internal space S from the outside of the apparatus body 2 through the first hold portions 51 provided in the left wall 2L and the right wall 2R (arrows D21 in FIG. 2). The air that is flowing in from the first hold portion 51 formed in the left wall 2L passes through an unillustrated opening to flow into the internal space S, and then cools components of the image forming portion 40.

On the other hand, with reference to FIG. 3, the air that is flowing in from the first hold portion 51 formed in the right wall 2R (arrows DF1 in FIG. 3) passes through the first communication space 52 to flow into the vertical conveyance path SP from the first blowout opening 53. The first blowout opening 53 allows the first communication space 52 defined by the first hold portion 51 to communicate with the lower part of the vertical conveyance path SP, the first hold portion being in the form of a hollow. This allows air to flow into the vertical conveyance path SP through the first hold portion 51 while preventing the intake port of the airflow (first blowout opening 53) from being seen from the outside of the apparatus body 2. At this time, the air flows into the lower part of the vertical conveyance path SP extending vertically. The flowing-in air is warmed in the vertical conveyance path SP to thereby flow upward (stack effect). Consequently, the airflow is guided upward from the lower part by the stack effect (arrows DF2 in FIG. 3). This allows the apparatus body 2 to reliably cool target components adjacent to the vertical conveyance path SP while satisfactorily maintaining its external design.

Specifically, in the present embodiment, the vertical conveyance path SP constitutes a part of the cooling air passage. This allows a sheet being conveyed in the vertical conveyance path SP (arrows DP in FIG. 3) to be cooled. This also allows a part of the vertical conveyance path SP to be cooled, the vertical conveyance path extending from the sheet feeding trays 110 to the discharge section 241.

Further, in the present embodiment, the first blowout opening 53 faces a part of the vertical conveyance path SP below the image forming portion 40. Therefore, air flowing into the vertical conveyance path SP from the first blowout opening 53 passes the zone facing the image forming portion 40 while flowing upward. This allows at least a part of the image forming portion 40 to be cooled. When the temperature rises around the transfer position TP where the intermediate transfer belt 42 and the second transfer roller 47 face each other as shown in FIG. 2, toner is likely to be adhered to the surface of the intermediate transfer belt 42. Accordingly, the first blowout opening 53 is provided below the transfer position TP to guide flowing-in air to pass the transfer position TP as described above, thereby preventing such adhesion of toner as described.

The air flowing upward in the vertical conveyance path SP in the form of updraft is discharged to the outside of the apparatus body 2 from the discharge opening 48P for discharging a sheet (arrow D22 in FIG. 2). In addition, as shown in FIG. 1, the airflow may be discharged to the outside of the apparatus body 2 from a joint 2S which is provided between the connecting housing 23 and the upper housing 22 and communicates with the internal space S (arrow D23 in FIG. 2). In this manner, the airflow is discharged by utilizing the opening that is provided in the apparatus body 2 in advance. Therefore, there is no need to make a new opening in the outer wall of the apparatus body 2, which therefore allows the apparatus body 2 to satisfactorily maintain its external design.

Further, the image forming apparatus 1 includes sheet guide ribs 54 (guide portion, guide ribs). With reference to FIG. 3, the sheet guide ribs 54 are rib members projecting from the first inner wall surface 2R1 toward the vertical conveyance path SP above the first blowout opening 53. The sheet guide ribs 54 extend vertically to guide a sheet along the vertical conveyance path SP. Further, the guide ribs 54 are disposed at intervals in a sheet width direction orthogonal to the direction of conveyance of sheet.

According to the above configuration, a gap is defined between the surface of a sheet being conveyed in the vertical conveyance path SP along the sheet guide rib 54, and the first inner wall surface 2R1. This allows air flowing in from the first blowout opening 53 to flow upward through the gap. This allows the airflow to come into contact with the surface of the sheet being conveyed in the vertical conveyance path SP. Consequently, the sheet is stably cooled. In addition, because the sheet guide ribs 54 are disposed at intervals in the sheet width direction, air flowing in from the first blowout opening 53 can flow upward through the gaps between the plurality of sheet guide ribs 54. This allows the airflow to be further stably maintained.

<Second Embodiment>

Figure 4:
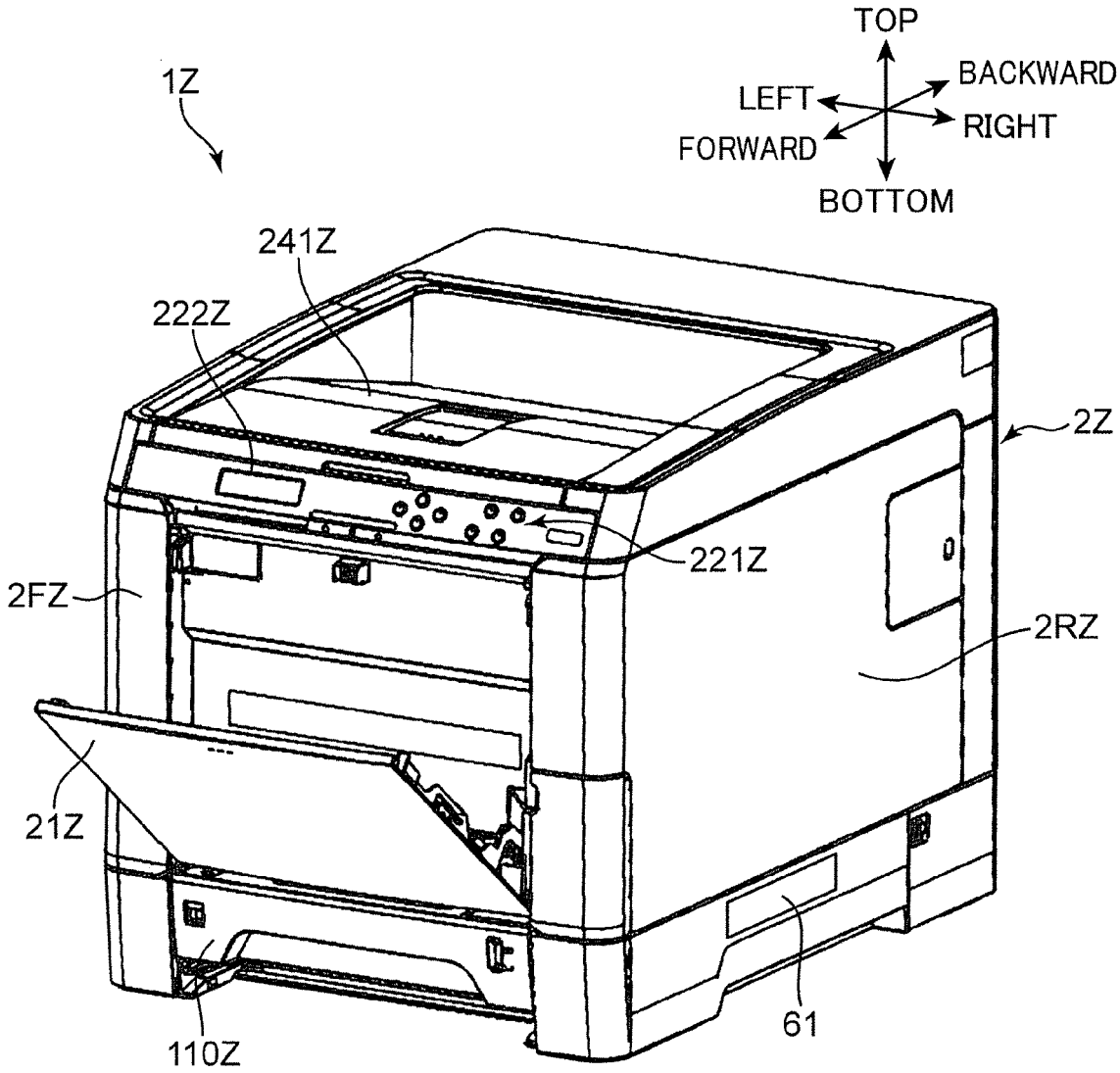
FIG. 4 is a perspective view of an image forming apparatus according to a second embodiment of the present disclosure.
Figure 5:
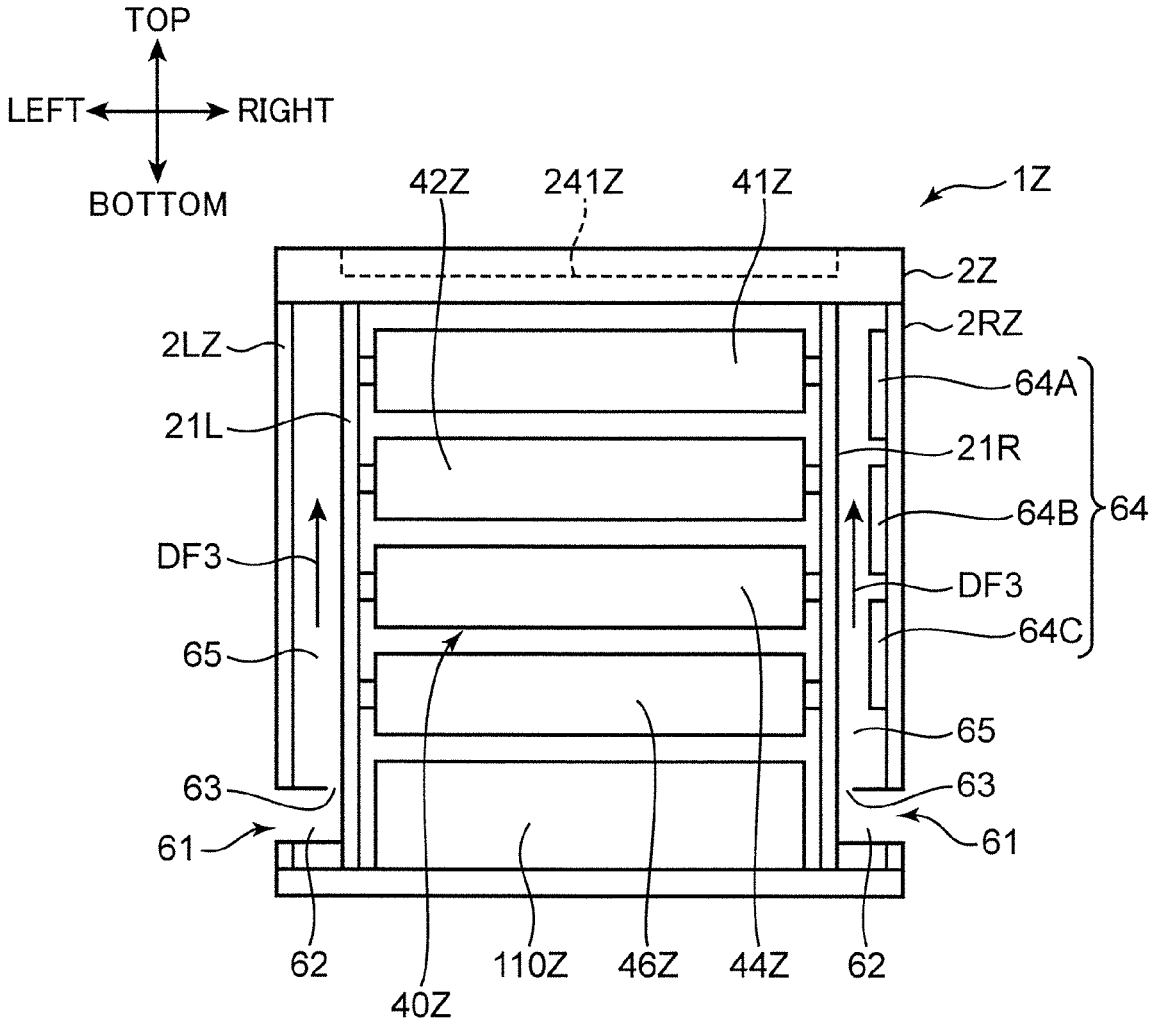
FIG. 5 is a schematic sectional view showing an internal structure of the image forming apparatus according to the second embodiment of the present disclosure.

Now, a second embodiment of the present disclosure will be described. FIG. 4 is a perspective view of an image forming apparatus 1Z according to the present embodiment. FIG. 5 is a schematic sectional view showing an internal structure of the image forming apparatus 1Z. The image forming apparatus 1Z is a so-called color printer.

The image forming apparatus 1Z includes an apparatus body 2Z having a substantially rectangular shape. In the present embodiment, a sheet formed with an image is discharged onto a discharge section 241 Z which is disposed on the upper surface of the apparatus body 2Z. The discharge section 241Z is located above an image forming portion 40Z to be described later.

There is an operation section 221Z which is disposed on the front upper edge of the apparatus body 2Z and includes, for example, an LCD touch panel 222Z. The operation section 221Z can receive input of information relating to image formation. The LCD touch panel 222Z allows a user to set the number, the print density or the like of sheets to be printed, for example.

The apparatus body 2Z includes a front wall 2FZ, a right wall 2RZ, and a left wall 2LZ (FIG. 5). The front wall 2FZ is a front wall of the apparatus body 2Z. The right wall 2RZ and the left wall 2LZ (each being a side wall) are right and left side walls of the apparatus body 2Z, respectively, the right and left walls standing vertically and perpendicularly to the front wall 2FZ. Further, the apparatus body 2Z includes a multi-tray 21Z, a left inner wall 21L (second inner wall), and a right inner wall 21R (second inner wall).

The multi-tray 21 Z constitutes a part of the front wall 2FZ, and is forwardly openable with respect to the apparatus body 2Z. When the multi-tray 21Z is in a forwardly opened state, a sheet can be placed on the multi-tray 21Z. The sheet will be subjected to toner image formation in the image forming portion 40Z. In other words, the multi-tray functions as a manual feed tray.

The left inner wall 21L stands in inner than and parallel with the left wall 2LZ. Similarly, the right inner wall 21R stands in inner than and parallel with the right wall 2RZ. The right inner wall 21R and the left inner wall 21L support the image forming portion 40Z. Further, as shown in FIG. 5, a pair of the right wall 2RZ and the right inner wall 21R, and a pair of the left wall 2LZ and the left inner wall 21L each define a space 65 therebetween, the space having a predetermined width in the lateral direction. The space 65 extends in the vertical and forward-backward direction in the apparatus body 2Z.

The image forming apparatus 1Z includes a sheet feeding tray 110Z (sheet storage), an unillustrated sheet feeding unit, and the image forming portion 40Z. The image forming portion 40Z includes a plurality of units consisting of toner containers 41Z, an intermediate transfer unit 42Z, a marking unit 44Z, and an exposure device 46Z.

The sheet feeding tray 110Z stores sheets. The sheet feeding tray 110Z can be pulled out from the apparatus body 2Z in the front direction (forward direction). The sheet feeding tray 110Z is disposed below the image forming portion 40Z. A sheet stored in the sheet feeding tray 110Z is conveyed rearward and upward in the apparatus body 2Z by the unillustrated sheet feeding unit. Thereafter, the sheet is subjected to toner image formation in the image forming portion 40Z and then discharged onto the discharge section 241Z.

The arrangement of the image forming portion 40Z in the present embodiment is similar to the arrangement of the image forming portion 40 in the first embodiment that is rotated by 90 degrees in a top view. Specifically, the toner containers 41Z are configured in the same manner as in the image forming portion 40 of the first embodiment, and the toner containers for the respective colors are disposed adjacently in the forward and backward direction. In addition, the intermediate transfer unit 42Z is configured in the same manner as the intermediate transfer belt 42 of the first embodiment. The intermediate transfer unit 42Z has a rear end defining a transfer position TP. The marking unit 44Z includes elements corresponding to the photoreceptor drums 43, the developing devices 44, the chargers 45, and the cleaning device of the first embodiment. The exposure device 46Z is equivalent to the exposure device 46 of the first embodiment. As shown in FIG. 5, the lateral ends of each of the toner container 41Z, the intermediate transfer unit 42Z, the marking unit 44Z, and the exposure device 46Z are supported on the left inner wall 21L and the right inner wall 21R. Consequently, the plurality of units included in the image forming portion 40Z are supported on the left inner wall 21L and the right inner wall 21R while being vertically adjacent to one another.

Further, the image forming apparatus 1Z includes second hold portions 61, second communication spaces 62, and second blowout openings 63. With reference to FIGS. 4 and 5, the second hold portions 61 are formed by making a hollow at a part of the right wall 2RZ and a part of the left wall 2LZ. The right and left second hold portions 61 face the sheet feeding tray 110Z in a horizontal direction. The second hold portions 61 are held by a worker when moving the apparatus body 2Z of the image forming apparatus 1Z. The second communication openings 62 are equivalent to the first communication space 52 described in the preceding first embodiment. The second hold portion 61 defines a part of the second communication spaces 62 that extend inner than each of the left wall 2LZ and the right wall 2RZ. As shown in FIG. 4, the second hold portion 61 is provided at a central portion in the forward-backward direction of the right wall 2RZ. The second communication space 62 lies inner than the second holding portion 61, and extends in the forward and backward directions farther than the second hold portion 61.

The second blowout opening 63 is provided in the top of the widthwisely inner end of each of the second communication spaces 62. The second blowout opening 63 allows the second communication opening 62 defined by the second hold portion 61 to communicate with a lower part of the above-described space 65.

In the present embodiment, the space 65 constitutes a cooling air passage for cooling the inside of the apparatus body 2Z of the image forming apparatus 1Z. The space 65 extends vertically so as to face the sheet feeding tray 110Z and the plurality of units included in the image forming portion 40Z.

This allows air flowing into the second blowout openings 63 through the second hold portions 61 and the second communication spaces 62 to flow into the respective spaces 65 that are provided between the right wall 2RZ and the right inner wall 21R and between the left wall 2LZ and the left inner wall 21L. The air flowing into the space 65 is gradually warmed to flow upward in the form of updraft (arrows DF3 in FIG. 5) in the space 65. This allows the left inner wall 21L and the right inner wall 21R supporting the image forming portion 40Z to be cooled by the airflow, thereby absorbing heat of the image forming portion 40Z to prevent temperature rise of the image forming portion 40Z.

In this manner, the present embodiment also allows air to flow into the spaces 65 from the second hold portions 61 while preventing the intake ports of the airflow (second blowout openings) from being seen from the outside of the apparatus body 2Z. This allows the apparatus body 2Z to reliably cool the target components (left inner wall 21 L, right inner wall 21R, and the image forming portion 40Z) that are adjacent to the spaces 65 while satisfactorily maintaining its external design.

Further, the image forming apparatus 1Z includes an electric substrate 64. The electric substrate 64 includes, for example, a high-voltage power source for supplying a driving voltage to the image forming portion 40Z. In addition, the electric substrate 64 includes a control substrate for sending and receiving various control signals to and from the image forming portion 40Z.

The electric substrate 64 is supported vertically on the right wall 2RZ and facing the space 65. The electric substrate 64 may alternatively be supported on the right inner wall 21R, the left inner wall 21L or the left wall 21 in other embodiments. The electric substrate 64 includes a plurality of substrates. Specifically, the electric substrate 64 includes a first substrate 64A, a second substrate 64B and a third substrate 64C. The plurality of substrates are disposed vertically adjacent to one another as shown in FIG. 5.

The above configuration makes it possible to dispose the electric substrate 64 by making use of the space 65 between the right wall 2RZ and the right inner wall 21R. Further, the electric substrate 64 is allowed to be cooled by air flowing into the space 65. This can prevent malfunction caused by a temperature rise of the electric substrate 64. Further, because the plurality of electric substrates (first substrate 64A, second substrate 64B, and the third substrate 64C) are disposed vertically adjacent to one another as described above, the electric substrates can be cooled in sequence by air flowing upward by the stack effect.

Although the image forming apparatuses 1 and 1Z according to the embodiments of the present disclosure have been described above, the present disclosure is not limited to the above embodiments and, for example, the following modified embodiments may be adopted.

Figure 6:
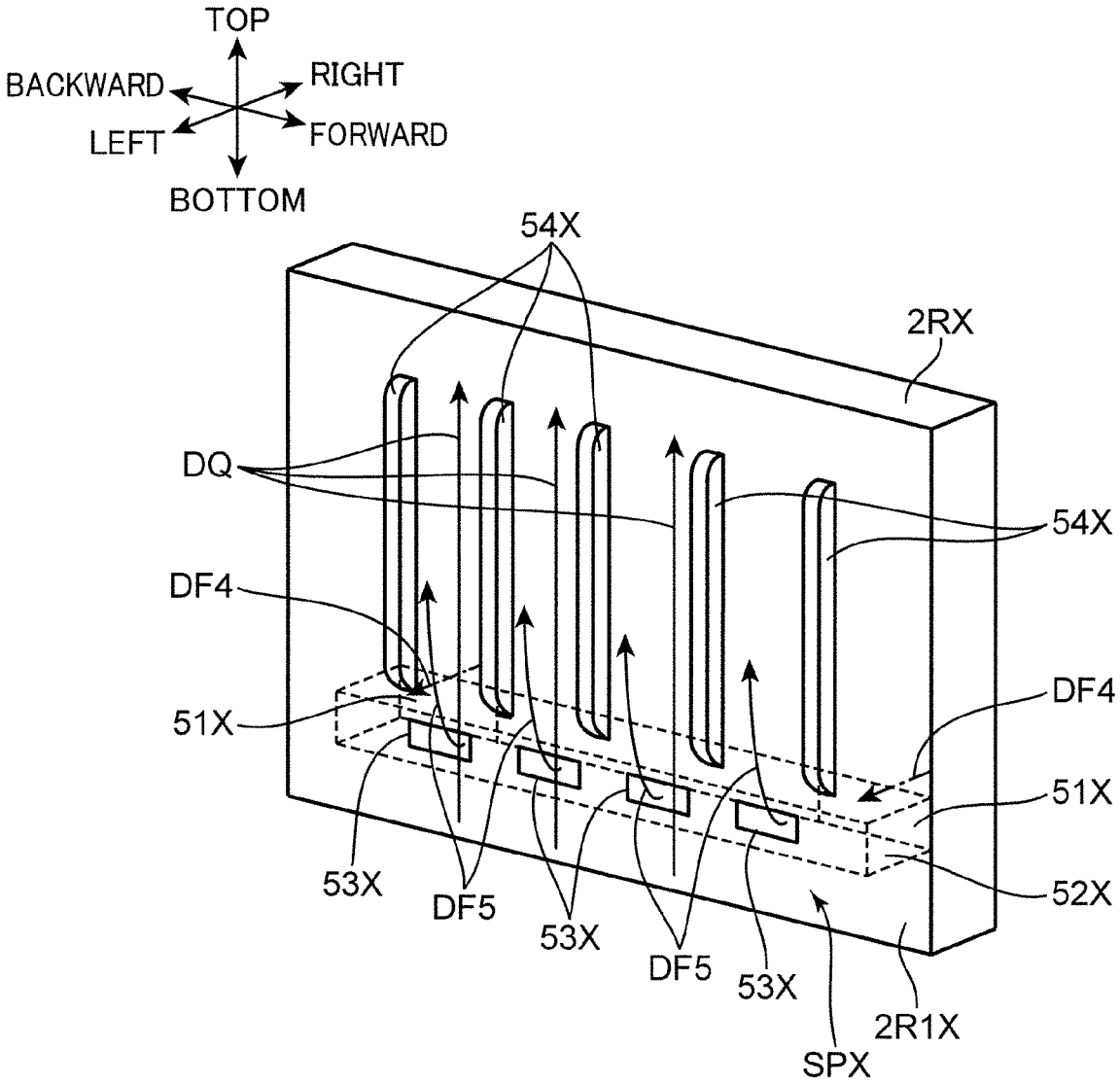
FIG. 6 is a perspective view of a cooling air passage in an image forming apparatus according to a modified embodiment of the present disclosure.

(1) In the above first embodiment, the first blowout opening 53 extends in the sheet width direction below the plurality of guide ribs 54, as shown in FIG. 3. The present disclosure is not limited to this embodiment. FIG. 6 is a perspective view of a right wall 2RX of an image forming apparatus (unillustrated) according to a modified embodiment of the present disclosure. The present modified embodiment differs from the preceding first embodiment in that third blowout openings 53X are provided. Accordingly, only the difference will be described, and repeated description of the other common features will be omitted. In addition, in FIG. 6, elements that are equivalent to those in the first embodiment shown in FIG. 3 are denoted by respective corresponding reference numerals in FIG. 3 with X added at the end.

With reference to FIG. 6, in the present modified embodiment, the image forming apparatus includes the third blowout openings 53X formed in an inner wall surface 2R1X. The third blowout openings 53X are disposed at intervals in a sheet width direction (forward-backward direction). One of the third blowout openings 53X is disposed below and between adjacent sheet guide ribs 54X (guide ribs) disposed in the sheet width direction. This allows air (arrows DF4 in FIG. 6) flowing into a vertical conveyance path SPX (first sheet conveyance path, cooling air passage) from a third hold portion 51X to quickly flow into each of gaps between adjacent guide ribs 54X (arrows DF5 in FIG. 6). This allows a sheet being conveyed in an arrow DQ direction in the vertical conveyance path SPX to be stably cooled, and also allows components of the image forming apparatus disposed adjacently to the vertical conveyance path SP to be stably cooled.

Figure 7:
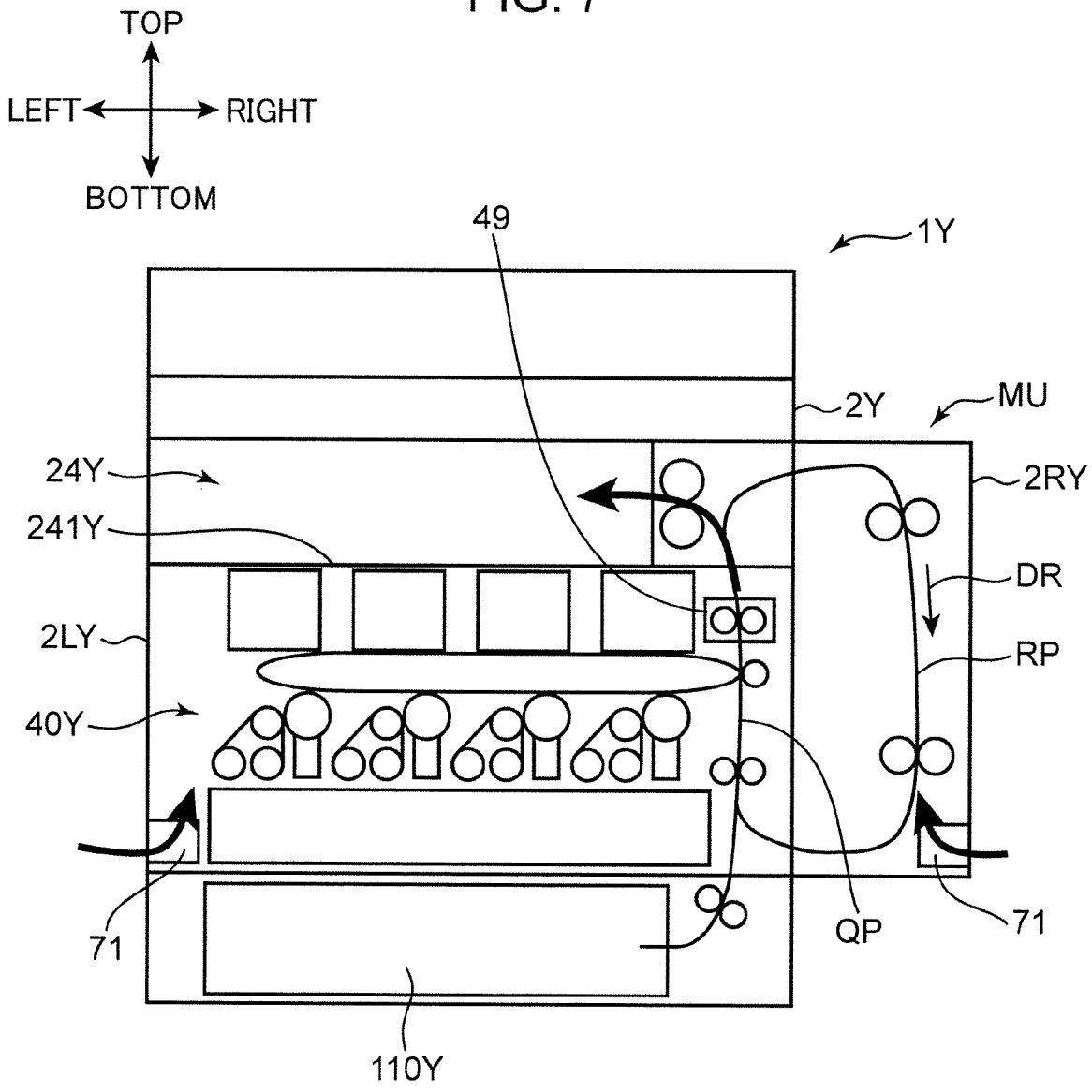
FIG. 7 is a schematic sectional view showing an internal structure of an image forming apparatus according to a modified embodiment of the present disclosure.

(2) In the above first embodiment, the cooling air passage provided in the apparatus body 2 is constituted by a part of the vertical conveyance path SP. The present disclosure is not limited to this embodiment. FIG. 7 is a schematic sectional view showing an internal structure of an image forming apparatus 1Y according to a modified embodiment of the present disclosure. The image forming apparatus 1Y differs from the image forming apparatus 1 according to the preceding first embodiment in that a conveyance unit MU is provided. Accordingly, only the difference will be described, and repeated description of the other common features will be omitted.

The image forming apparatus 1Y includes an apparatus body 2Y, a sheet feeding tray 110Y (sheet storage), a discharge section 241Y defining a discharge space 24Y, an image forming portion 40Y, a fixing unit 49, a sheet conveyance path QP (second sheet conveyance path), and a conveyance unit MU. The sheet feeding tray 110Y is disposed below the image forming portion 40Y and stores sheets. The image forming portion 40Y forms a toner image on a sheet. The fixing unit 49 applies a fixing treatment to the sheet formed with the toner image. The discharge section 241Y is disposed above the image forming portion 40Y and to which the sheet formed with the image is discharged. The sheet conveyance path QP extends from the sheet feeding tray to the discharge section 241Y through a zone facing the image forming portion 40Y, for conveying a sheet upward from the bottom.

The conveyance unit MU is an add-on unit for the apparatus body 2Y. The conveyance unit MU includes a reverse conveyance path RP (third conveyance path) therein. The reverse conveyance path RP is branched from the sheet conveyance path QP at a downstream side than the image forming portion 40Y. The reverse conveyance path RP conveys a sheet in an arrow DR direction to send it back into a part of the sheet conveyance path QP below the image forming portion 40Y (on the upstream side in the conveyance direction), the sheet being formed with an image on the front surface. The sheet having been put back in the sheet conveyance path QP will be formed with a toner image also on the back surface, to thereby allow the sheet to have the both sides formed with an image.

In the present modified embodiment, a part of the above-described reverse conveyance path RP constitutes a cooling air passage. With reference to FIG. 7, the image forming apparatus 1Y includes fourth hold portions 71. The fourth hold portion 71 is formed in each of a left wall 2LY of the image forming apparatus 1Y and a right wall 2RY (side wall) of the conveyance unit MU. In the same manner as in the preceding first embodiment, an unillustrated communication opening allows the fourth hold portion 71 in the conveyance unit MU to communicate with a lower part of the reverse conveyance path RP.

The above configuration also makes it possible to satisfactorily maintain the external design of the apparatus body 2Y of the image forming apparatus 1Y while reliably cooling components that are adjacent to the reverse conveyance path RP to be cooled. Further, a sheet being conveyed in the reverse conveyance path RP is allowed to be cooled by air flowing in from the communication opening. Specifically, in the present modified embodiment, a sheet having been conveyed into the reverse conveying path RP is heated when receiving a fixing treatment by the fixing unit. Accordingly, a part of the reverse conveyance path RP is utilized as a cooling air passage to thereby allow the sheet to be sufficiently cooled before starting to be conveyed toward the image forming portion 40Y again. Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an apparatus body including a front wall, and a side wall standing perpendicularly to the front wall, the front wall and the side wall defining an internal space;

an image forming portion disposed in the internal space for forming an image on a sheet;

a sheet storage disposed below the image forming portion for storing sheets;

a discharge portion disposed above the image forming portion for discharging a sheet formed with an image; and a sheet conveyance path extending from the sheet storage to the discharge portion through a zone facing the image forming portion, the sheet conveyance path allowing a sheet to be conveyed therethrough a hold portion in the form of a hollow at a part of the side wall, and adapted to be held when moving the apparatus body;

a cooling air passage extending in the internal space vertically along the side wall and constituting a part of the conveyance path from a position below the image forming portion to a position above the image forming portion; and a communication opening for allowing communication between a space defined by the hold portion and a lower part of the cooling air passage.

2. An image forming apparatus according to claim 1, wherein the communication opening faces the first conveyance path below the image forming portion.

3. An image forming apparatus according to claim 1, further comprising:

a guide portion provided above the communication opening for guiding a sheet.

4. An image forming apparatus according to claim 3, wherein the guide portion includes a plurality of guide ribs projecting toward the sheet conveyance path and extending vertically for guiding a sheet, the guide ribs being disposed at an interval in a sheet width direction orthogonal to a direction of conveyance of a sheet.

5. An image forming apparatus according to claim 4, further comprising another communication opening for allowing communication between the space defined by the hold portion and the lower part of the cooling air passage, and the communication opening and the another communication opening being provided at an interval in the sheet width direction, wherein at least one of the communication openings is disposed below and between the guide ribs adjacent to each other in the sheet width direction.

6. An image forming apparatus according to claim 1, further comprising:

an inner wall standing along and inward of the side wall for supporting the image forming portion; and the side wall and the inner wall defining a space portion for the cooling air passage.

7. An image forming apparatus according to claim 6, further comprising:

an electric substrate facing the space portion, and supported on the side wall or inner wall.

8. An image forming apparatus according to claim 7, wherein the electric substrate includes a plurality of substrates, the plurality of substrates being disposed vertically adjacent to one another.

9. An image forming apparatus comprising:

an apparatus body including a front wall, and a side wall standing perpendicularly to the front wall, the front wall and the side wall defining an internal space;

an image forming portion disposed in the internal space for forming an image on a sheet;

a hold portion in the form of a hollow at a part of the side wall and adapted to be held when moving the apparatus body;

a sheet storage disposed below the image forming portion for storing sheets;

a discharge portion disposed above the image forming portion for discharging a sheet formed with an image;

a first sheet conveyance path extending from the sheet storage to the discharge portion through a zone facing the image forming portion, the first sheet conveyance path allowing a sheet to be conveyed therethrough; and a second sheet conveyance path branched from the first sheet conveyance path at a downstream side than the image forming portion, the second sheet conveyance path allowing a sheet formed with an image to be conveyed therethrough to a part of the first sheet conveyance path that is below the image forming portion;

a cooling air passage extending in the internal space vertically along the side wall and constituting a part of the second sheet conveyance path; and a communication opening for allowing communication between a space defined by the hold portion and a lower part of the cooling air passage.

10. An image forming apparatus, comprising:

an apparatus body including a front wall and a side wall standing perpendicularly to the front wall, the front wall and the side wall defining an internal space, a second inner wall standing along and inward of the side wall so that the side wall and the second inner wall define a space portion that extends vertically;

an image forming portion disposed in the internal space for forming an image on a sheet, the image forming portion including a plurality of units that are supported on the second inner wall and that are vertically adjacent to one another so that the plurality of units face the space portion;

a sheet storage disposed below the image forming portion for storing sheets, the sheet storage facing the space portion;

a hold portion in the form of a hollow at a part of the side wall, and adapted to be held when moving the apparatus body, the hold portion facing the sheet storage in a horizontal direction;

a cooling air passage extending in the internal space vertically in the space portion between the side wall and the second inner wall; and a communication opening for allowing communication between a space defined by the hold portion and a lower part of the cooling air passage.

* * * * *